US010337816B2

(12) United States Patent
Geissele

(10) Patent No.: US 10,337,816 B2
(45) **Date of Patent: *Jul. 2, 2019**

(54) TRIGGER MECHANISM FOR A FIREARM

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/851,156

(22) Filed: Dec. 21, 2017

(65) Prior Publication Data

US 2018/0135929 A1 May 17, 2018

Related U.S. Application Data

(63) Continuation of application No. 15/380,188, filed on Dec. 15, 2016, now Pat. No. 9,927,197, which is a continuation-in-part of application No. 29/579,212, filed on Sep. 28, 2016, now Pat. No. Des. 828,895.

(51) Int. Cl.

| | |
|---|---|
| ***F41A 19/10*** | (2006.01) |
| ***F41A 19/14*** | (2006.01) |
| ***F41A 17/46*** | (2006.01) |
| ***F41A 19/44*** | (2006.01) |
| ***F41A 19/45*** | (2006.01) |

(52) U.S. Cl.

CPC ..... *F41A 17/46* (2013.01); *F41A 19/10* (2013.01); *F41A 19/44* (2013.01); *F41A 19/45* (2013.01)

(58) Field of Classification Search

CPC ..... F41A 19/10; F41A 19/12; F41A 19/14; F41A 19/42; F41A 19/44; F41A 19/45; F41A 19/17; F41A 19/31

See application file for complete search history.

(56) References Cited

U.S. PATENT DOCUMENTS

| | | | | |
|---|---|---|---|---|
| 644,402 A * | 2/1900 | Bye | ..... | F41A 19/10 42/69.01 |
| 1,147,906 A * | 7/1915 | Swebilius et al. | ..... | F41A 19/45 42/70.06 |
| 2,037,065 A * | 4/1936 | Burton | ..... | F41A 19/45 89/145 |

(Continued)

*Primary Examiner* — Derrick R Morgan
(74) *Attorney, Agent, or Firm* — Fox Rothschild LLP

(57) ABSTRACT

A trigger mechanism includes a hammer element that has a ready position, an intermediate position, and a fired position. The hammer element includes a hammer sear and a notch positioned at a front of the hammer element. The trigger mechanism includes a trigger element has a ready position that retains the hammer element in the ready position. The trigger mechanism also includes a fired position that releases the hammer element. The trigger element includes a trigger sear that includes a hammer sear engagement zone and a notch engagement zone. When the hammer element is in the ready position, the trigger sear at least partially engages the hammer sear at the hammer sear engagement zone. When the hammer element is in the intermediate position, the trigger sear at least partially engages the notch at the notch engagement zone and not at the hammer sear engagement zone.

20 Claims, 14 Drawing Sheets

(56) References Cited

U.S. PATENT DOCUMENTS 2,189,202 A * 2/1940 Garland ..... F41A 17/56 42/70.05
2,341,033 A * 2/1944 Garland ..... F41A 19/45 89/144
2,406,980 A * 9/1946 Young ..... F41A 19/24 42/41
2,464,427 A * 3/1949 Wilson ..... F41A 19/48 89/139
2,703,943 A * 3/1955 Roemer ..... F41A 19/42 42/66
2,855,716 A * 10/1958 Campbell ..... F41A 19/45 42/69.03
3,152,418 A * 10/1964 Charron ..... F41A 19/48 42/65
3,251,268 A * 5/1966 Menneking ..... F41A 19/44 89/131
3,292,492 A * 12/1966 Sturtevant ..... F41A 19/02 89/128
4,017,996 A * 4/1977 Liedke ..... F41A 19/45 42/69.03
5,086,579 A * 2/1992 Flatley ..... F41A 17/74 42/69.03
5,166,458 A * 11/1992 Yoo ..... F41A 19/45 42/69.03
5,712,443 A * 1/1998 Canaday ..... F41A 15/12 42/69.03
5,724,759 A * 3/1998 Kilham ..... F41A 17/46 42/66
5,760,328 A * 6/1998 Robbins ..... F41A 19/02 89/129.02
5,913,261 A * 6/1999 Guhring ..... F41A 3/64 42/69.03
6,119,387 A * 9/2000 Butters ..... F41A 17/82 42/70.08
6,125,735 A * 10/2000 Guhring ..... F41A 19/02 42/69.03
7,204,051 B2 * 4/2007 Thomele ..... F41A 17/72 42/69.03
7,854,084 B1 * 12/2010 Rutherford ..... F41A 19/43 42/69.01
8,112,928 B2 * 2/2012 Keough ..... F41A 19/46 42/69.03
8,893,607 B2 * 11/2014 Audibert ..... F41A 19/10 89/136
9,046,313 B1 * 6/2015 Lutton ..... F41A 17/46
9,146,066 B1 * 9/2015 Cason ..... F41A 19/09
9,310,150 B1 * 4/2016 Geissele ..... F41A 19/16
D764,004 S * 8/2016 Bender ..... D22/108
D781,987 S 3/2017 Geissele
D783,112 S 4/2017 Geissele
D783,759 S 4/2017 Geissele
9,618,288 B2 * 4/2017 Wilson ..... F41A 19/10
9,618,289 B1 4/2017 Geissele
9,638,485 B2 5/2017 Geissele
9,696,103 B2 * 7/2017 Bender ..... F41A 19/14
9,719,744 B2 * 8/2017 Horch ..... F41A 19/16
9,733,034 B1 * 8/2017 Viani ..... F41A 19/10
9,777,980 B2 * 10/2017 Heizer ..... F41A 3/86
9,784,518 B2 10/2017 Geissele
9,791,233 B2 10/2017 Geissele
9,927,197 B1 3/2018 Geissele
9,927,198 B2 3/2018 Geissele
2005/0217652 A1 * 10/2005 Styles ..... F41A 7/08 124/32
2006/0101695 A1 * 5/2006 Longueira ..... F41A 9/45 42/69.02
2009/0183414 A1 * 7/2009 Geissele ..... F41A 19/10 42/69.03
2010/0037502 A1 * 2/2010 Fluhr ..... F41A 19/14 42/69.01
2010/0229843 A1 * 9/2010 Hu ..... F41A 19/02 124/80
2011/0079137 A1 * 4/2011 Audibert ..... F41A 19/10 89/136
2011/0315002 A1 * 12/2011 Keough ..... F41A 19/46 89/128
2015/0153126 A1 * 6/2015 Bender ..... F41A 19/14 42/69.01
2015/0330734 A1 * 11/2015 Kolev ..... F41A 3/12 42/69.01
2015/0338181 A1 * 11/2015 McAlister ..... F41A 19/10 42/6
2016/0010933 A1 * 1/2016 Bonner ..... F41A 19/14 42/69.01
2016/0061549 A1 * 3/2016 Patterson ..... F41A 17/56 42/69.01
2016/0131448 A1 * 5/2016 Bender ..... F41A 19/10 42/69.01
2016/0161202 A1 * 6/2016 Larue ..... F41A 19/45 42/69.01
2016/0363401 A1 * 12/2016 Elftmann ..... F41A 19/15
2017/0089656 A1 * 3/2017 Alicea, Jr. ..... F41A 19/59
2017/0097204 A1 * 4/2017 Geissele ..... B23H 9/00
2017/0122686 A1 * 5/2017 Fellows ..... F41A 19/24
2017/0131054 A1 * 5/2017 Geissele ..... F41A 19/46
2017/0321983 A1 * 11/2017 Bender ..... F41A 19/14
2018/0045481 A1 * 2/2018 Williams ..... F41A 19/42
2018/0087860 A1 * 3/2018 Sullivan ..... F41A 17/46

* cited by examiner

TRIGGER MECHANISM FOR A FIREARM

CROSS-REFERENCE TO RELATED APPLICATIONS

This application is a continuation of U.S. patent application Ser. No. 15/380,188 filed Dec. 15, 2016 (now U.S. Pat. No. 9,927,197), which is a continuation-in-part of U.S. patent application Ser. No. 29/579,212 filed Sep. 28, 2016 (now U.S. Pat. No. D828,895), the disclosures of all of which are hereby incorporated by reference in their entireties.

BACKGROUND

Firearms are configured to fire rounds of ammunition. To fire a firearm, the user of the firearm can pull a trigger mechanism, which releases a hammer. The hammer is designed to then strike a firing pin which, in turn, strikes an impact sensitive round of ammunition. Once struck, the round of ammunition expels a bullet from the barrel of the firearm toward a target.

Some shooters prefer a firearm trigger mechanism that requires a low pull back force (e.g., competitive shooters). This allows for very precise operation of the firearm. However, the lighter the trigger pull, the easier the trigger mechanism is to activate (i.e., pull). Because of this, the risk of an accidental discharge of the firearm is greater. An accidental discharge can occur if the firearm is mishandled or dropped, resulting in a dangerous situation. Therefore, improvements in firearm trigger mechanisms are needed.

SUMMARY

The present disclosure relates generally to a trigger mechanism for a firearm.

In one aspect of the present disclosure a trigger mechanism for a firearm is disclosed. The trigger mechanism includes a hammer element that has a ready position, an intermediate position, and a fired position. The hammer element includes a hammer sear and a notch positioned at a front of the hammer element. The trigger mechanism includes a trigger element has a ready position that retains the hammer element in the ready position. The trigger mechanism also includes a fired position that releases the hammer element. The trigger element includes a trigger sear that includes a hammer sear engagement zone and a notch engagement zone. When the hammer element is in the ready position, the trigger sear at least partially engages the hammer sear at the hammer sear engagement zone. When the hammer element is in the intermediate positon, the trigger sear at least partially engages the notch at the notch engagement zone and not at the hammer sear engagement zone.

In another aspect of the present disclosure a firearm is disclosed. The firearm includes a trigger mechanism. The trigger mechanism includes a hammer element that is rotatable about a hammer rotation axis. The hammer element has a first hammer sear. The firearm includes a trigger element that is rotatable independently from the hammer element about a trigger rotation axis. The trigger element has a ready position and a fired position. When the trigger element is in the ready position, the hammer sear is retained by the trigger sear, and when the trigger element is in the fired position, the hammer element is not retained by the trigger sear. The firearm includes a disconnector pivotally connected to the trigger element. The disconnector has a hammer engagement surface that is configured to receive a portion of the hammer element when the hammer element is moving from the fired position to the ready position. The hammer engagement surface is positioned between the hammer rotation axis and the trigger rotation axis.

In another aspect of the present disclosure a firearm receiver is disclosed. The firearm receiver includes a receiver housing and a trigger mechanism housed by the receiver housing. The trigger mechanism includes a hammer element that is rotatable about a hammer rotation axis. The hammer element has a ready position, an intermediate position, and a fired position. The hammer element includes a hammer sear and a notch positioned at a front of the hammer element. The trigger mechanism includes a trigger element that is rotatable independently from the hammer element about a trigger rotation axis. The trigger element has a ready position that retains the hammer element in the ready position, and a fired position that releases the hammer element. The trigger element includes a trigger sear that includes a hammer sear engagement zone and a notch engagement zone. When the hammer element is in the ready position, the trigger sear at least partially engages the hammer sear at the hammer sear engagement zone, and, when the hammer element is in the intermediate positon, the trigger sear at least partially engages the notch at the notch engagement zone and not at the hammer sear engagement zone; The firearm receiver includes a disconnector pivotally connected to the trigger element. The disconnector has a hammer engagement surface that is configured to receive a portion of the hammer element when the hammer is moving from the fired position to the ready position. The hammer engagement surface is positioned between the hammer rotation axis and the trigger rotation axis.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
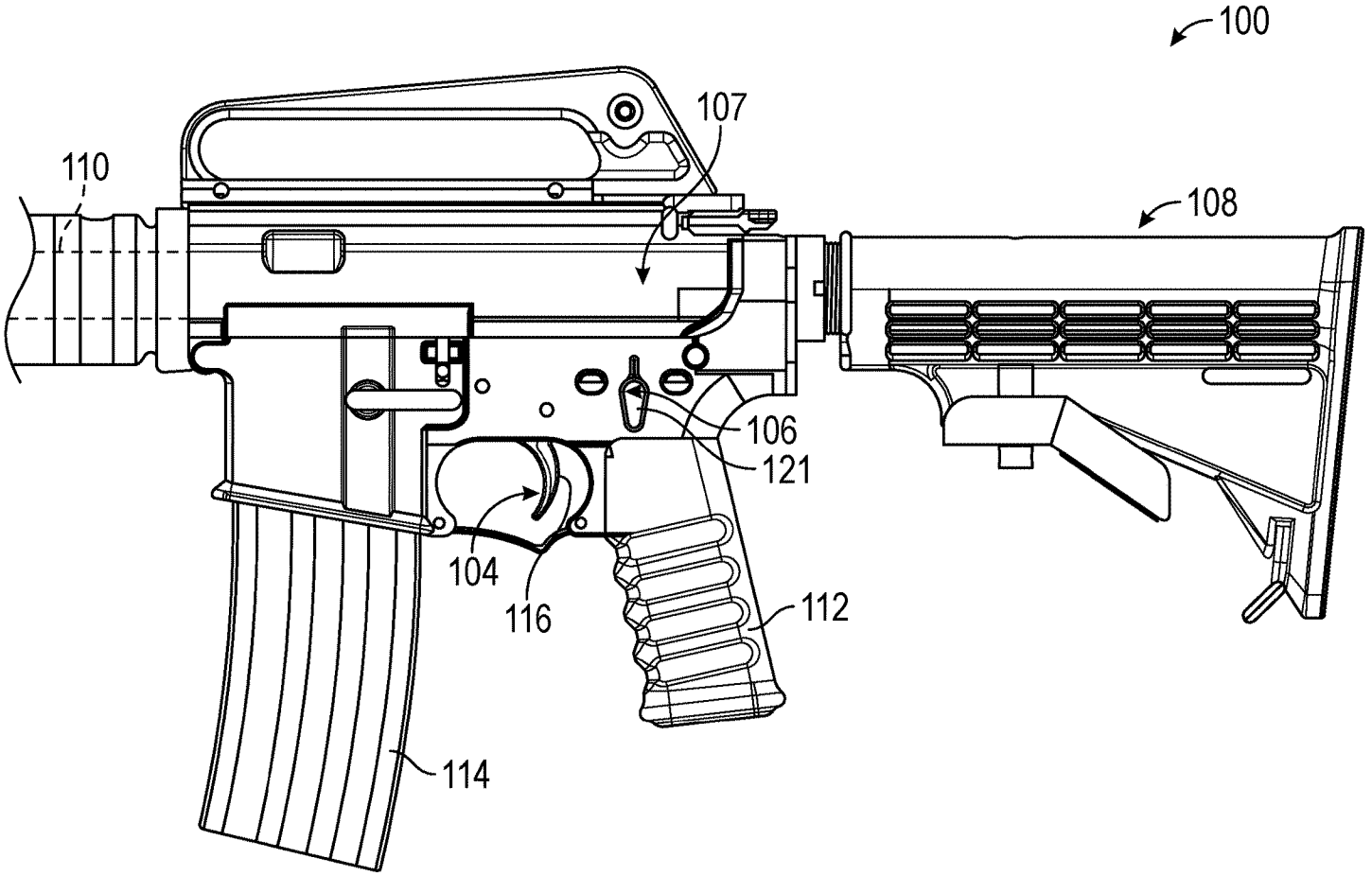
FIG. 1 illustrates a perspective view of an example firearm, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a schematic side view of an example firearm 100. In this example, the firearm 100 includes a receiver body 102. In some embodiments, the receiver body 102 includes a trigger mechanism 104 and a safety mechanism 106. In some embodiments, the firearm 100 may also include a stock 108, a barrel 110, a grip 112, and, in some embodiments, an ammunition magazine 114.

The firearm 100 is configured to have a plurality of operating modes. The operating modes include at least a safe mode and a fire mode. When the firearm 100 is in the safe mode, the firearm 100 is prevented from discharging a round of ammunition. When the firearm 100 is in the fire mode, the firearm 100 is discharged each time that the trigger mechanism 104 is activated (i.e., "pulled") without manually reloading ammunition.

The firearm 100 can be of a variety of types. Examples of a firearm include handguns, rifles, shotguns, carbines, and personal defense weapons. In at least one embodiment, the firearm is a Colt AR-15 rifle or a variant of the AR 15.

The receiver body 102 is configured to house a firing mechanism and associated components as found in, for example, assault rifles and their variants. The firing mechanism includes the trigger mechanism 104, which is described and illustrated in more detail with reference to FIGS. 2-17. A bolt assembly (not shown) can also be slidably disposed in the receiver body 102 for axially reciprocating recoil movement therein during a firing cycle sequence of the firearm 100. The bolt assembly is configured to interface with the trigger mechanism 104.

The trigger mechanism 104 includes a trigger bow 116 configured to be pulled by the finger of the shooter (e.g., the index finger) to initiate the firing cycle sequence of the firearm 100. The trigger mechanism 104 is mounted to the receiver body 102. The trigger mechanism 104 is configured to discharge the firearm 100 when a predetermined amount of force is applied to the trigger bow 116. As described herein, the trigger mechanism 104 can be designed to replace the OEM trigger mechanism of the firearm 100, such as assault type rifles, and provide multiple shooting modes, or can be designed as an OEM trigger mechanism. The trigger mechanism 104 is installed in the receiver body 102.

The safety mechanism 106 is configured to facilitate the switching of the firearm 100 between different operating modes. As mentioned above, each operating mode alters the behavior of the firearm 100. In at least one embodiment, the safety mechanism 106 includes a safety mechanism lever 121 that is switchable between multiple positions, such as a fire mode position and a safe mode position. The safety mechanism 106 is in communication with the trigger mechanism 104. Further, the safety mechanism 106 is disposed in the side of the receiver body 102.

The stock 108 is configured to be positioned at a rearward portion of the firearm 100. The stock 108 provides an additional surface for a shooter to support the firearm 100, preferably against the shooter's shoulder. In some embodiments, the stock 108 includes a mount for a sling. In other embodiments the stock 108 is a telescoping stock. In other embodiments still, the stock 108 is foldable. In some embodiments, the stock 108 is removably mounted to the receiver body 102. In at least one embodiment, the stock 108 is threaded to the receiver body 102. In other embodiments, the stock 108 is secured to the receiver body 102 by a fastener.

The barrel 110 is positioned at a forward end of the firearm 100 and is configured to be installed to the receiver body 102. The barrel 110 provides a path to release an explosion gas and propel a projectile therethrough. In some embodiments, the barrel 110 assembly includes a rail system for mounting accessories (e.g., a fore-grip, a flashlight, a laser, optic equipment, etc.) thereto. A portion of the barrel 110 is shown in FIG. 1.

The grip 112 provides a point of support for the shooter of the firearm and can be held by the shooter's hand, including when operating the trigger mechanism 104. The grip 112 assists the shooter in stabilizing the firearm 100 during firing and manipulation of the firearm 100. In some embodiments, the grip 112 is mounted to the receiver body 102.

The magazine 114 is an ammunition storage and feeding device within the firearm 100. In at least one embodiment, the magazine 114 is detachably installed on the firearm 100. For example, the magazine 114 is removably inserted into a magazine well of the receiver body 102 of the firearm 100.

Other embodiments of the firearm 100 have other configurations than the examples illustrated and described with reference to FIG. 1. For example, some of the components listed above are not included in some alternative embodiments.

Figure 2:
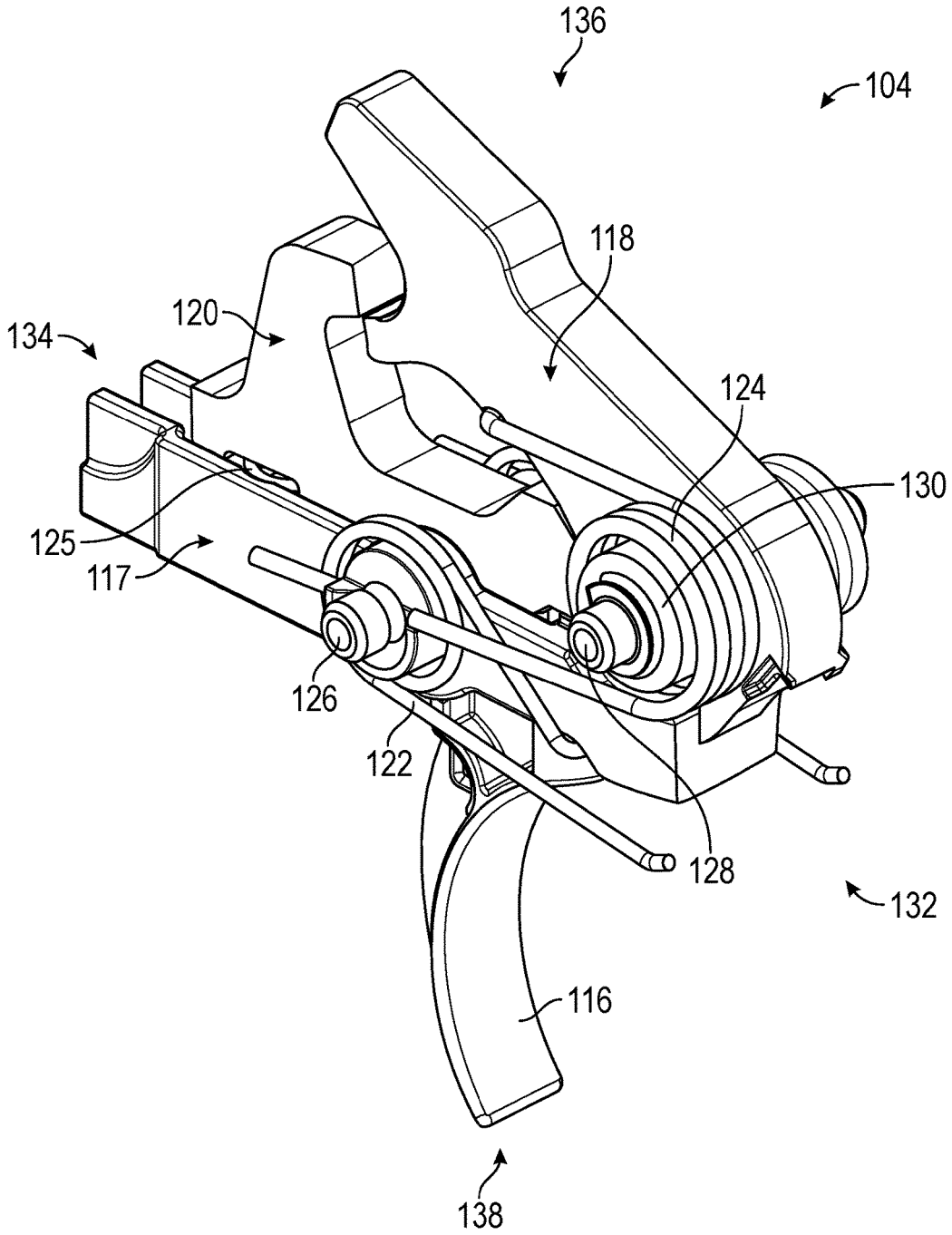
FIG. 2 illustrates a perspective view of a trigger mechanism, according to one embodiment of the present disclosure.
Figure 3:
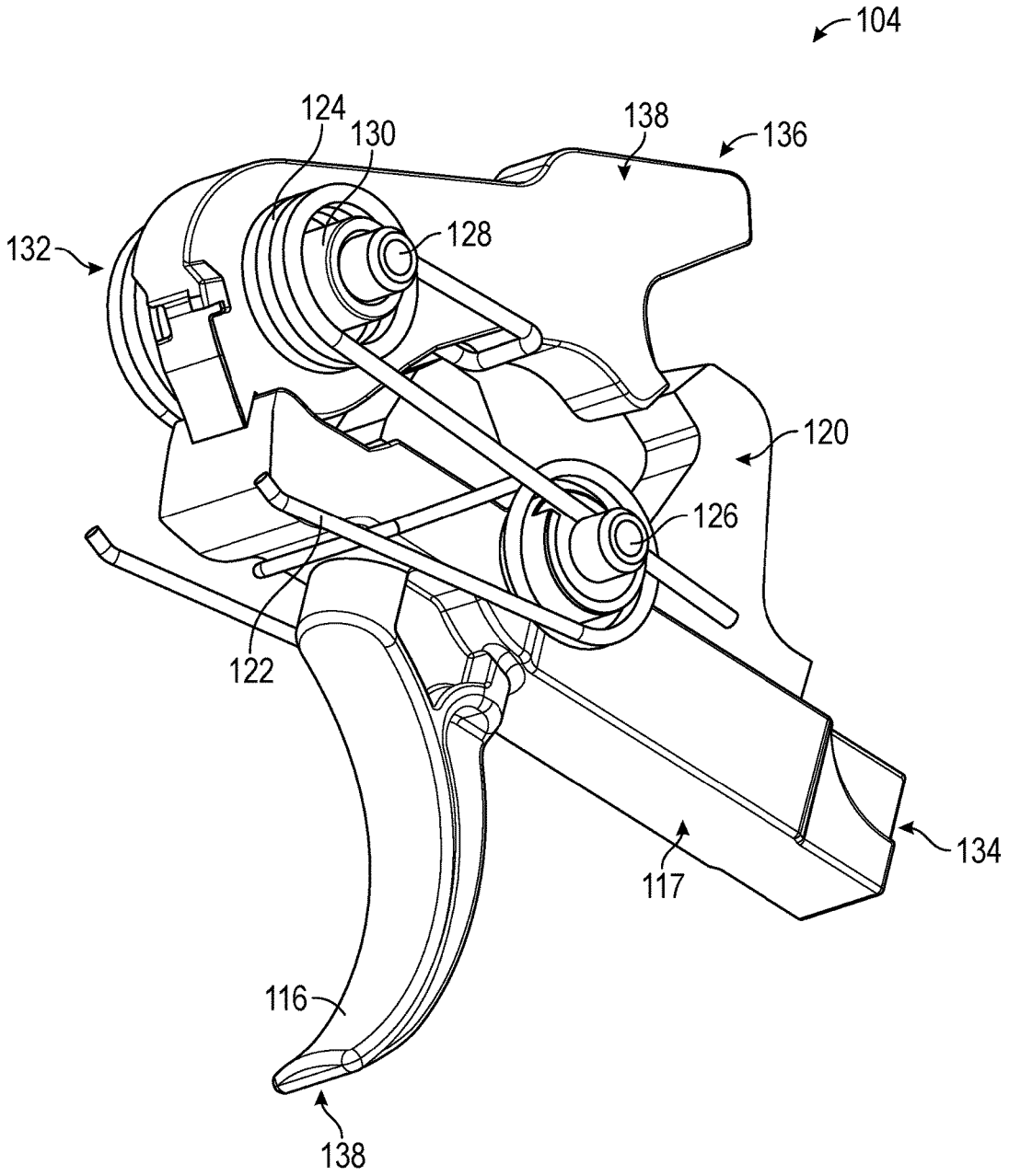
FIG. 3 illustrates another perspective view of the trigger mechanism of FIG. 2.

FIGS. 2 and 3 are perspective views of the trigger mechanism 104 suitable for use in the firearm 100 depicted in FIG. 1. The trigger mechanism 104 includes the trigger bow 116 attached to a trigger element 117, a hammer element 118, a disconnector 120, a trigger element spring 122, a hammer element spring 124, a disconnector spring 125, a trigger element pin 126, a hammer element pin 128, and a hammer element pin sleeve 130. Each portion of the trigger mechanism 104 will be described in detail below.

The trigger mechanism 104 is defined by a front 132, a back 134, a top 136, and a bottom 138. Throughout this disclosure, references to orientation (e.g., front(ward), rear (ward), in front, behind, above, below, high, low, back, top, bottom, under, underside, etc.) of structural components shall be defined by that component's positioning in FIGS. 2 and 3 relative to, as applicable, the front 132, the back 134, the top 136, and the bottom 138 of the trigger mechanism 104, regardless of how the trigger mechanism 104, or the attached firearm 100, may be held and regardless of how that component may be situated on its own (i.e., separated from the trigger mechanism 104).

In at least one embodiment, the trigger mechanism 104 is configured to provide a single stage trigger mechanism that provides a single stage resistance which causes the firearm 100 to be discharged once the single resistance is overcome.

As described herein, one or more of the pivotable elements of the trigger mechanism 104 include one or more contact surfaces on which one or more of the other pivotable or movable elements of the trigger mechanism 104 can selectively contact or slide. The trigger mechanism 104 is operated by the interactions between the movable or pivotable elements of the trigger mechanism 104. The interactions can include surface-to-surface contacts between the elements of the trigger mechanism 104.

The trigger element 117 is connected to the trigger element spring 122, which aids in moving the trigger element 117. The trigger element 117 is rotatable about the trigger element pin 126 about a trigger rotation axis. The safety mechanism 106 is configured to disengage and engage the trigger element 117. The safety mechanism 106 has at least a safe position and a fire position. When the safety mechanism 106 is in the safe position, the trigger element 117 is prevented from rotating and therefore firearm 100 is prevented from firing.

Similarly, the hammer element 118 is rotatable about the hammer element pin 128 about a hammer rotation axis. The hammer element 118 is connected to the hammer element spring 124, which aids in moving the hammer element 118. The hammer element pin sleeve 130 is positioned within the hammer element 118 and placed around the hammer element pin 128, being fixed thereto by way of a retainer ring 140 (shown in FIG. 4). The hammer element spring 124 then engages the hammer element pin sleeve 130 so as to allow the hammer element spring 124 to move the hammer element 118. The hammer element pin 128 and the trigger element pin 126 are each configured to be mounted and secured within the receiver body 102 of the firearm 100.

The disconnector 120 is configured to seat at least partially within the trigger element 117. The disconnector 120 is rotatable about the trigger element pin 126 and biased by the disconnector spring 125, which is positioned within the trigger element 117.

Figure 4:
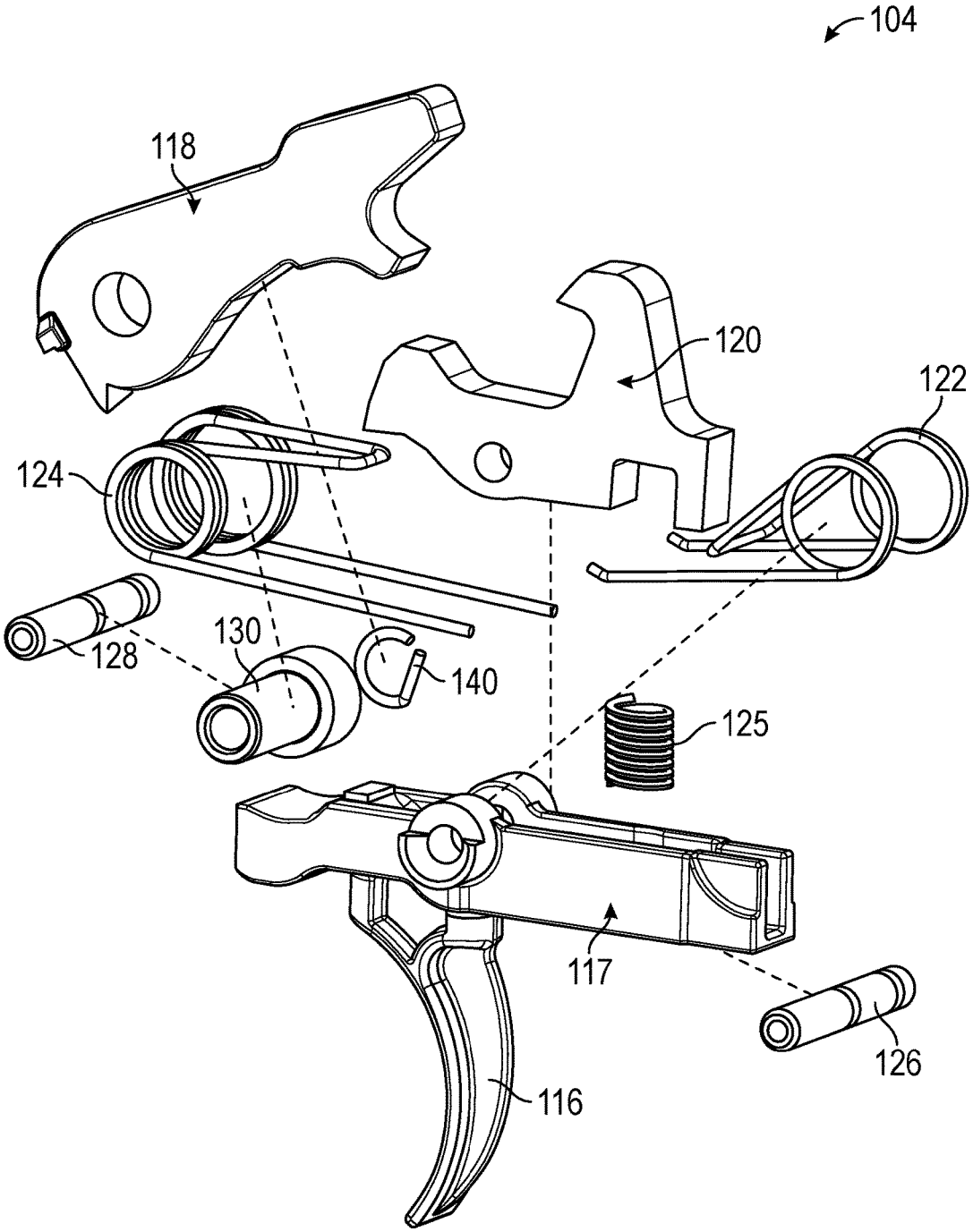
FIG. 4 illustrates an exploded view of the trigger mechanism of FIG. 2.
Figure 5:
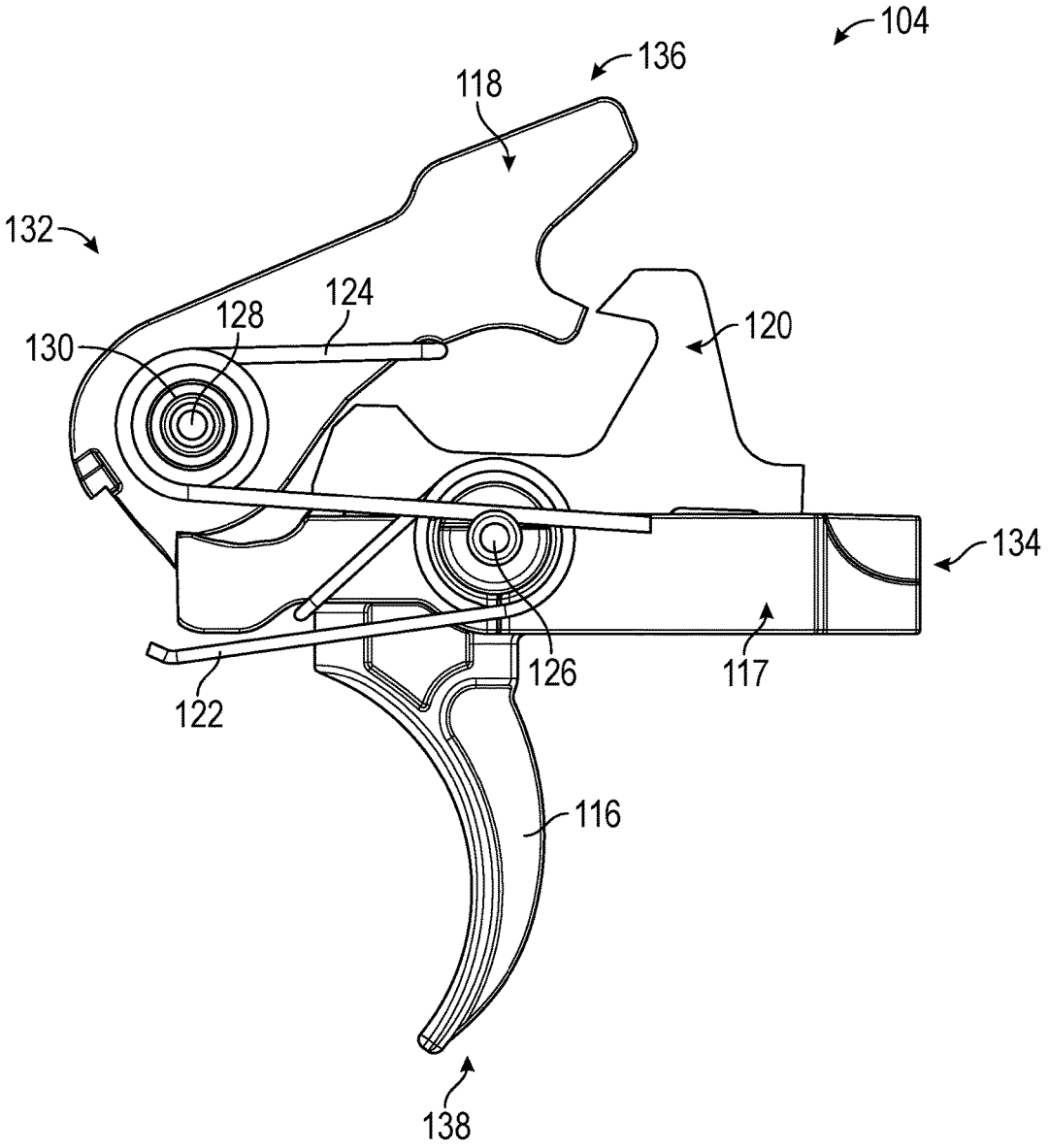
FIG. 5 illustrates a side view of the trigger mechanism of FIG. 2.
Figure 6:
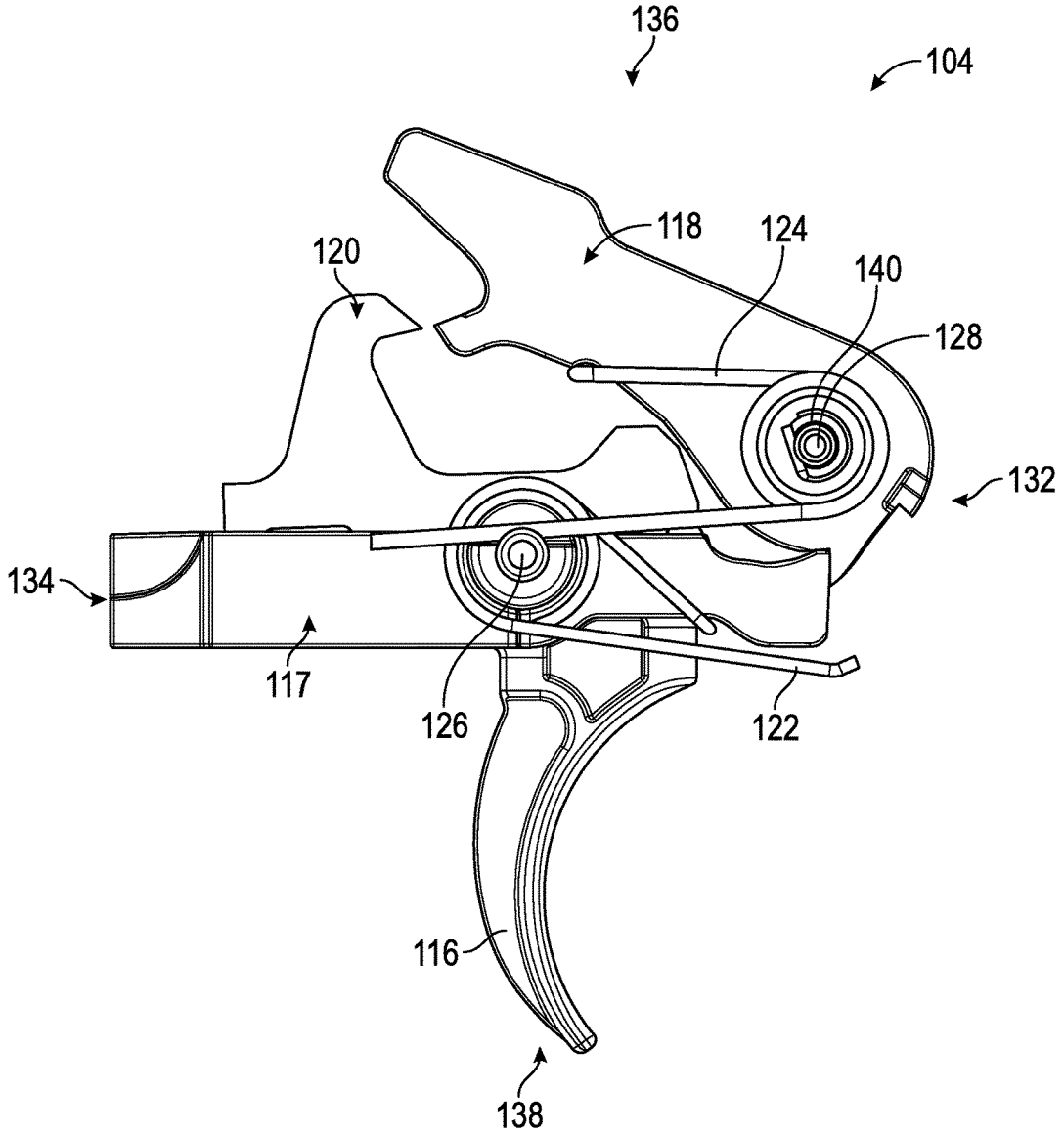
FIG. 6 illustrates another side view of the trigger mechanism of FIG. 2.

FIG. 4 is an exploded view of the trigger mechanism 104 suitable for use in the firearm 100 depicted in FIG. 1. The trigger mechanism 104 includes the trigger bow 116 attached to the trigger element 117, the hammer element 118, the disconnector 120, the trigger element spring 122, the hammer element spring 124, the disconnector spring 125, the trigger element pin 126, and the hammer element pin 128. FIGS. 5 and 6 show side views of the trigger mechanism 104.

Figure 7:
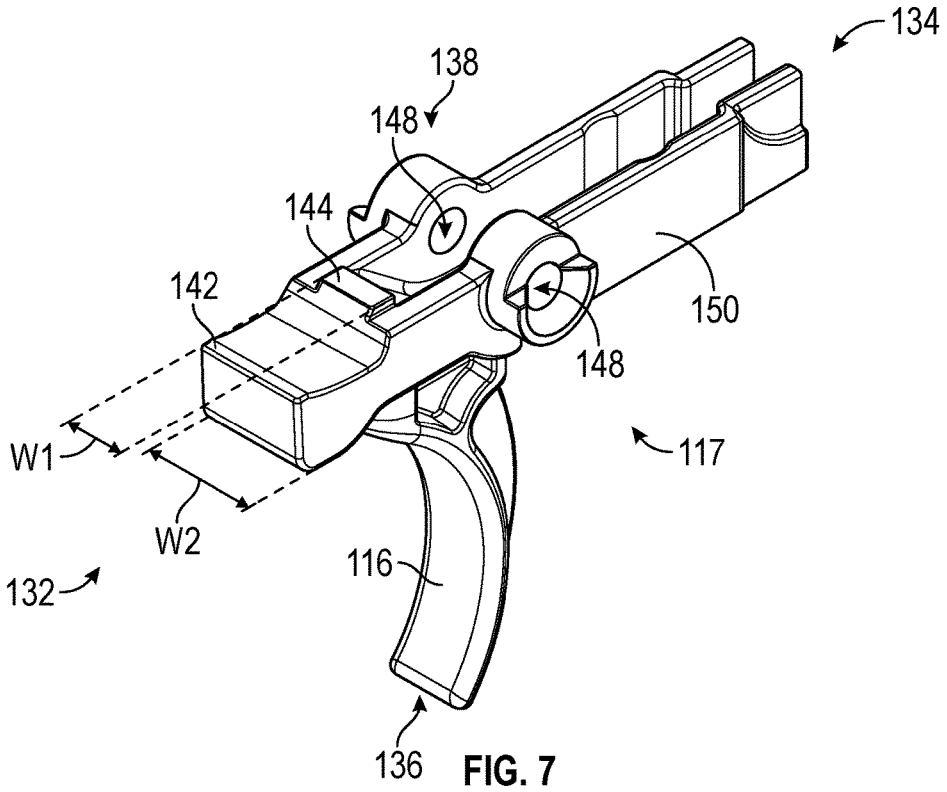
FIG. 7 illustrates a perspective view of a trigger element of the trigger mechanism of FIG. 2.
Figure 8:
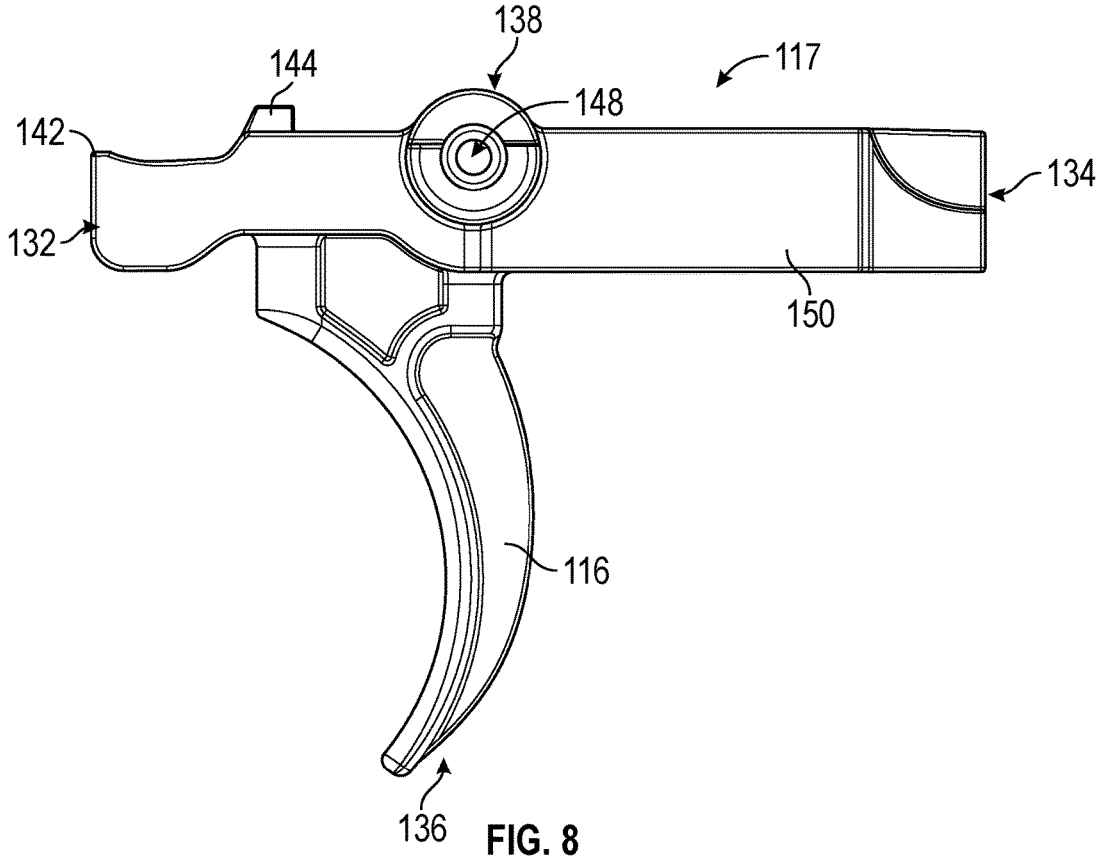
FIG. 8 illustrates a side view of the trigger element of FIG. 7.

FIG. 7 shows a perspective isometric view of the trigger element 117 and FIG. 8 shows a side view of the trigger element 117. The trigger element 117 includes the trigger bow 116, a trigger sear 142, and a disconnector pad 144. In some embodiments, the trigger element 117 has a ready position (shown in FIG. 15) and a fired position (shown in FIG. 17). When in the ready position, a rotation (known as a "pull") of the trigger bow 116 attached to the trigger element 117 about the trigger element pin 126 moves the trigger element 117 to the fired position, thereby releasing the hammer element 118 and causing a firearm (for example the firearm 100 of FIG. 1), to which the trigger mechanism 104 is attached, to discharge.

The trigger bow 116 is configured to receive a pulling force from the firearm user, usually by way of a finger pull. The rotation of the trigger bow 116 moves the trigger element 117 into the fired position. When in the fired position, a pull of the trigger bow 116 does not activate the firearm. In order for the firearm to discharge again, the trigger bow 116 must be moved from the fired position to the ready position. The trigger bow 116 can have a variety of different shapes. For example, in some examples, the bow can have a generally curved profile. In other embodiments, the bow can have a generally straight profile.

The trigger sear 142 of the trigger element 117 is configured to interact with the hammer element 118. The trigger sear 142 is positioned at the front 132 of the trigger element 117 and includes a generally flat uniform surface.

The disconnector pad 144 is configured to interact with the disconnector 120. The disconnector pad 144 is positioned on the trigger element 117 at a location between the trigger sear 142 and a trigger element pin receive recess 148. The trigger element pin receive recess 148 is configured to receive the trigger element pin. The disconnector pad 144 has a width W1 that is less than a width W2 of the trigger element 117. The disconnector pad 144 is also raised above side walls 150 of the trigger element 117.

Figure 9:
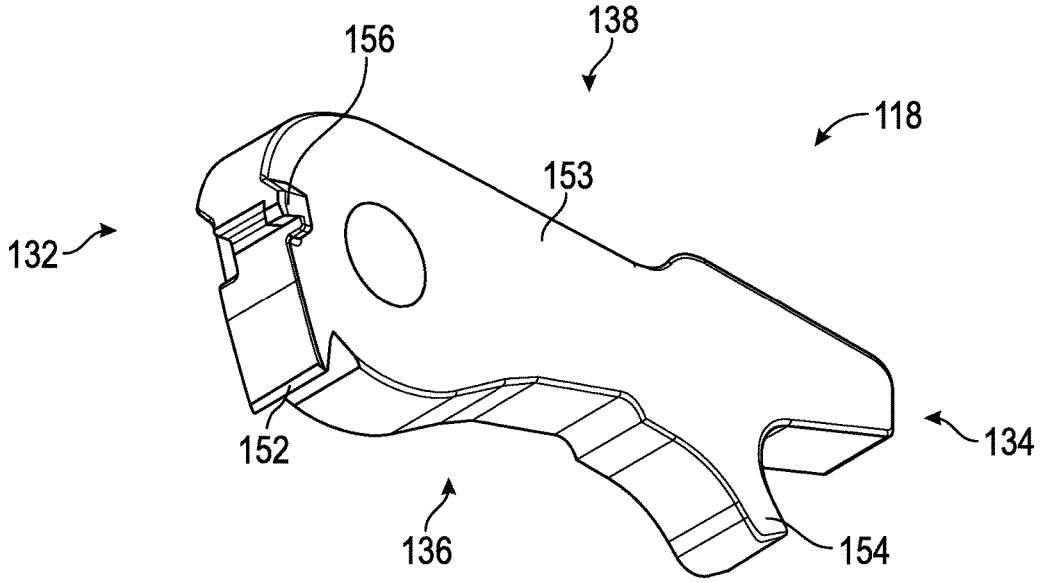
FIG. 9 illustrates a perspective view of a hammer element of the trigger mechanism of FIG. 2.
Figure 10:
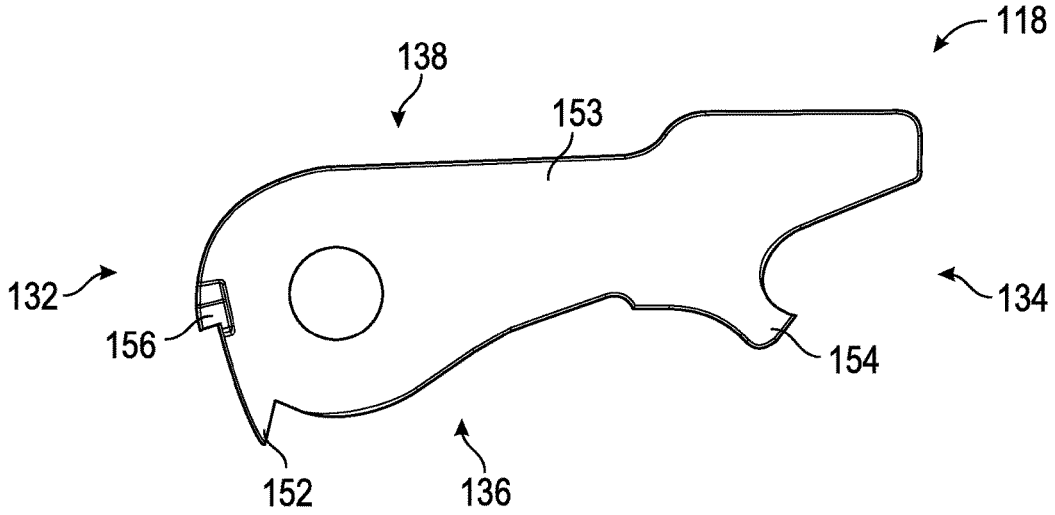
FIG. 10 illustrates a side view of the hammer element of FIG. 9.
Figure 11:
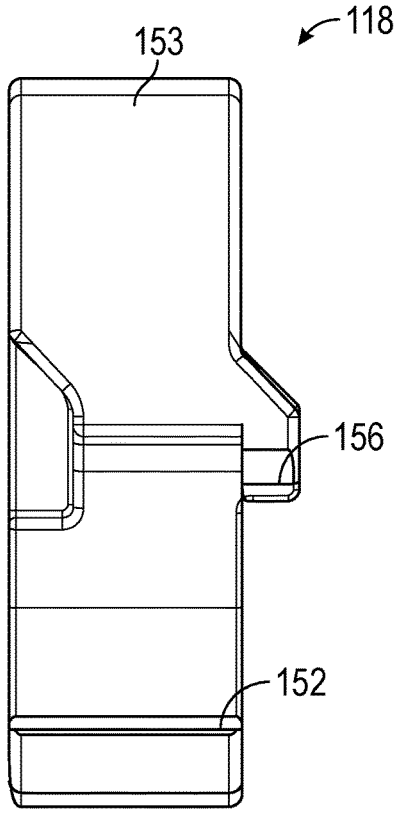
FIG. 11 illustrates a front view of the hammer element of FIG. 9.

FIG. 9 shows a perspective isometric view of the hammer element 118 and FIG. 10 shows a side view of the hammer element 118. FIG. 11 shows a front view of the hammer element 118. The hammer element 118 includes a first hammer sear 152, a main body 153, a second hammer sear 154, and a notch 156. The hammer element 118 is configured to pivot about the hammer element pin 128 between a ready position and a fired position, such that the hammer element 118 strikes a firing pin of a bolt assembly (not shown) of the firearm 100 as it moves from the ready position to the fired position. The hammer element 118 is spring-loaded so that the hammer element spring 124 powers the hammer element's movement between the ready position and the fired position.

The first hammer sear 152 is configured to interface with a portion of the trigger sear 142 of the trigger element 117. The first hammer sear 152 is retained by the trigger sear 142 when the trigger element 117 and the hammer element 118 are in the ready position. The first hammer sear 152 is disposed across the entire width of the main body 153 of the hammer element 118.

The second hammer sear 154 is configured to interface with the disconnector 120 when the trigger element 117 is in the fired position and the hammer element 118 is near the ready position. The second hammer sear 154 allows the hammer element 118 to be retained by the disconnector 120 if the trigger element 117 is held in a fired position. This is to prevent the hammer element 118 from constantly cycling from the ready to the fired position without the shooter having to pull the trigger element 117 from the ready to the fired position.

The notch 156 of the hammer element 118 allows the hammer element 118 to have an intermediate position between the fired position and the ready position. The hammer element 118 is shown in the intermediate position in FIG. 16. The notch 156 projects from the main body 153 of the hammer element 118. The notch 156 allows the hammer element 118 to be caught by the trigger sear 142 in the instance where the first hammer sear 152 of the hammer element 118 becomes dislodged from the trigger sear 142. For example, if the first hammer sear 152 inadvertently releases from the trigger sear (e.g., caused by the firearm being dropped or jostled), the notch 156 catches the hammer element 118 on the trigger sear 142 before the hammer element 118 moves to the fired position. By catching the hammer element 118 on the trigger sear 142 at the notch 156, the hammer element 118 is prevented from moving to the fired position, which would discharge the firearm 100. However, due to the spring rate of the hammer element spring 124 and the position of the trigger element 117 when in the fired position, the notch 156 of the hammer element 118 bypasses the trigger sear 142 so as to allow the hammer element 118 to move to the fired position when the shooter moves the trigger element to the fired position. Therefore, the notch 156 is configured to only catch the trigger sear 142 when the trigger element 117 is not in the fired position. The notch 156 allows the trigger mechanism 104 to have a very light pull back force, while also helping to reduce the chance of an accidental discharge.

Figure 12:
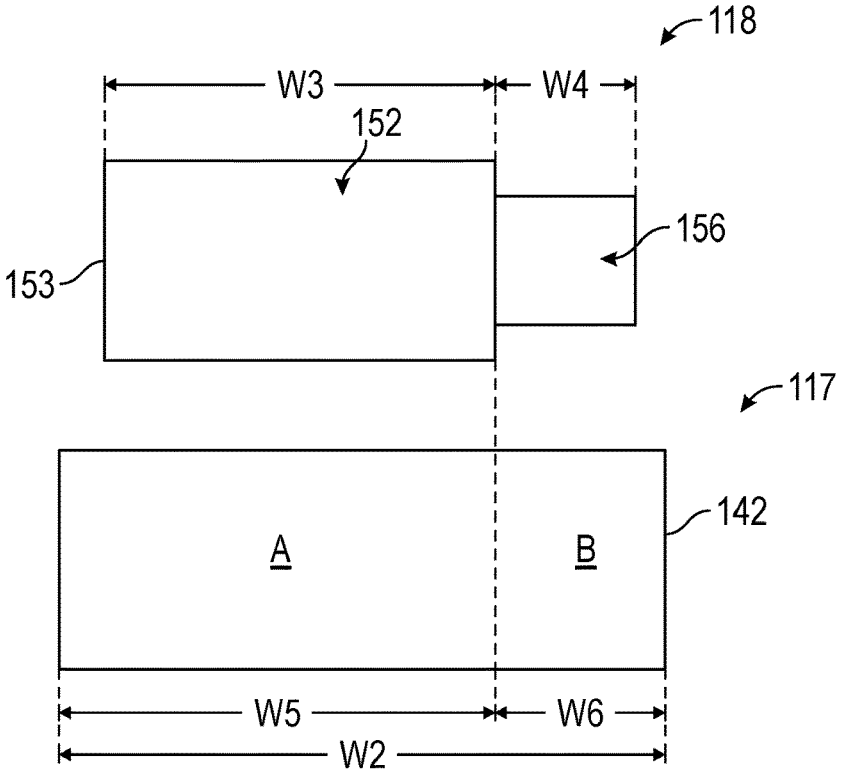
FIG. 12 illustrates a schematic front view of the trigger element of FIG. 7 and the hammer element of FIG. 9.

FIG. 12 shows a schematic front view representation of the trigger sear 142, the first hammer sear 152, and the notch 156. As described above, the trigger sear 142 has a width W2. The width W2 is greater than or equal to the combined width of the width W3 of the first hammer sear 152 and the width W4 of the notch 156. Accordingly, the trigger sear 142 has a hammer sear engagement zone A and a notch engagement zone B. The hammer sear engagement zone A only engages the first hammer sear 152 and the notch engagement zone B only engages the notch 156. Such separation of the zones A and B reduces the chance that the trigger sear 142 will become damaged by the notch 156. Because the interaction of the first hammer sear 152 and the trigger sear 142 is important with regards to the operation and feel of the trigger mechanism 104, damage to either the first hammer sear 152 or the hammer sear engagement zone A can reduce performance of the trigger mechanism 104. In the event of the notch 156 having to catch the hammer element 118, because the notch 156 projects from the main body 153 of the hammer element 118, the notch 156 only engages the trigger sear 142 at the notch engagement zone B, thereby substantially reducing the possibility of the notch 156 damaging the hammer sear engagement zone A. The hammer sear engagement zone A has a width W5 that is greater than or equal to the width W3 of the first hammer sear 152. The notch engagement zone B has a width W6 that is greater than or equal to the width W4 of the notch 156

Figure 13:
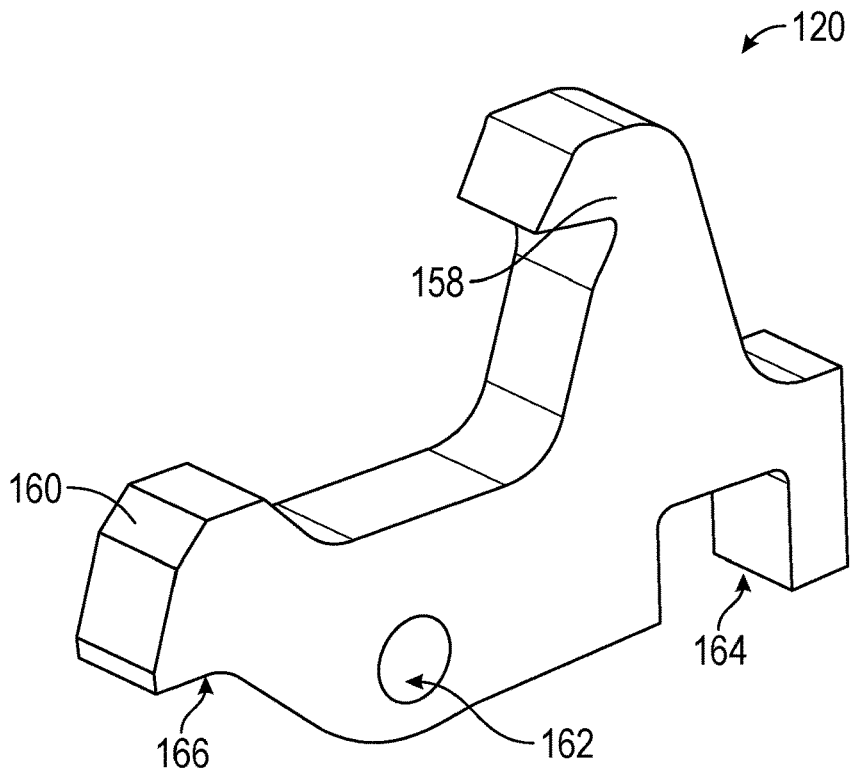
FIG. 13 illustrates a perspective view of a disconnector of the trigger mechanism of FIG. 2.
Figure 14:
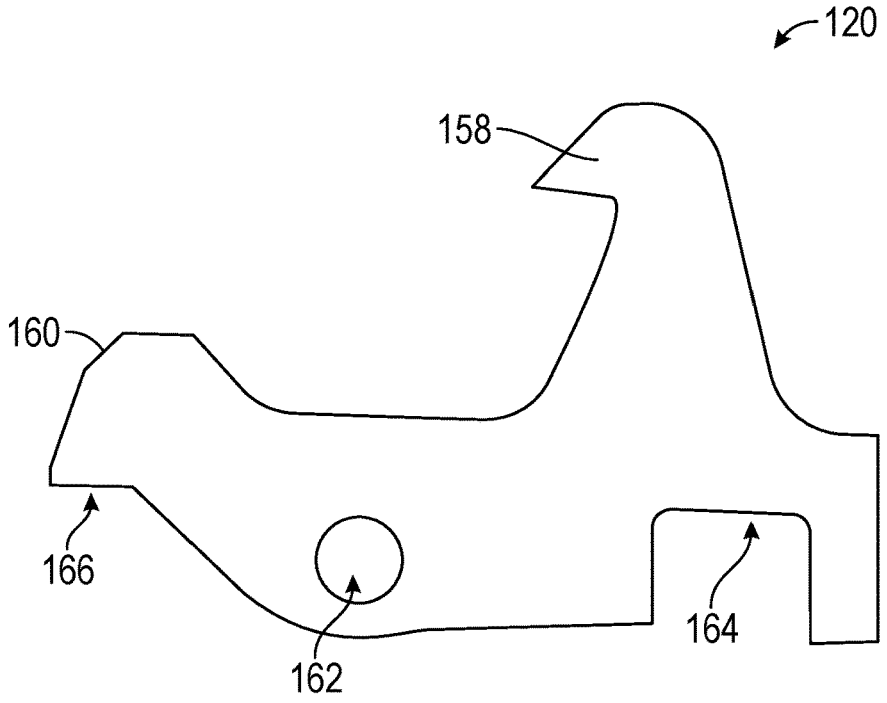
FIG. 14 illustrates a side view of the disconnector of FIG. 13.

FIG. 13 shows a perspective isometric view of the disconnector 120 and FIG. 14 shows a side view of the disconnector 120. The disconnector 120 includes a disconnector sear 158, a hammer stop 160, a trigger pin recess 162, a spring recess 164, and a trigger disconnector pad engagement surface 166. The disconnector sear 158 is configured to potentially retain the second hammer sear 154 if the trigger element 117 is held in the fired position, as described above. The disconnector 120 receives the trigger element pin 126 at the trigger pin recess 162 and engages the disconnector spring 125 at the spring recess 164. The trigger disconnector pad engagement surface 166 receives the disconnector pad 144 of the trigger element 117 when the hammer element 118 moves from the fired position to the ready position.

The hammer stop 160 receives the hammer element 118 when the hammer moves from the fired position to the ready position. The hammer stop 160 helps to direct the force of the hammer element 118 to the disconnector pad 144 of the trigger element 117. This allows the force exerted by the hammer element 118 on the disconnector 120 and the trigger element 117 to be focused at a location that is less likely to damage the trigger mechanism 104. Specifically, the hammer element force is transferred to the disconnector pad 144 at a point between the trigger element pin 126 and the hammer element pin 128. Such a force location reduces wear at the trigger element pin 126, leading to increased reliability and an increased life span of the trigger mechanism 104.

Figure 15:
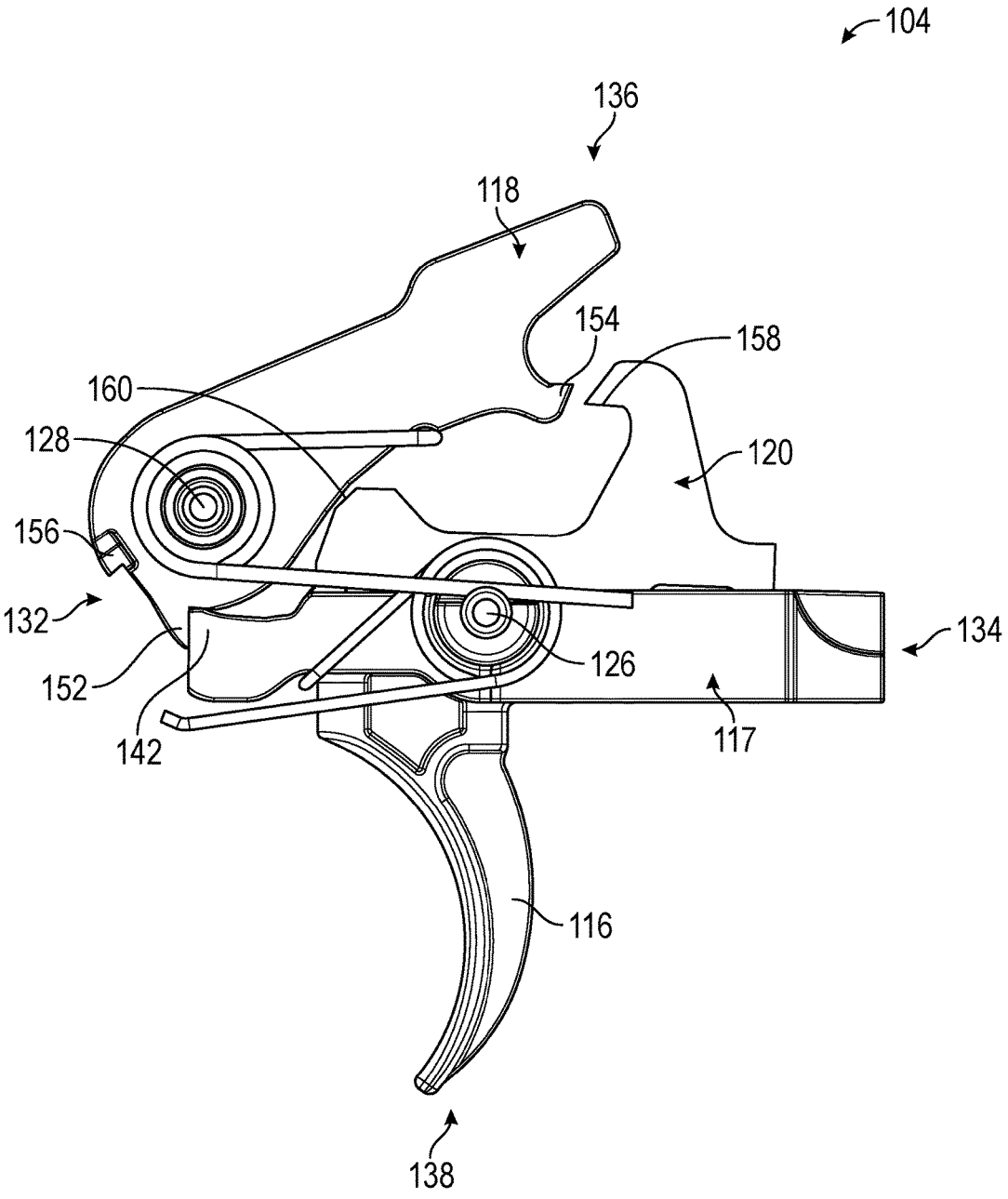
FIG. 15 illustrates the trigger mechanism of FIG. 2 in a ready position.

The trigger mechanism 104 is shown in a variety of positions in FIGS. 15-18. FIG. 15 shows the trigger element 117 and hammer element 118 in the ready position. The first hammer sear 152 is shown being held by the trigger sear 142. Further, the hammer element 118 is not contacting the disconnector 120.

Figure 16:
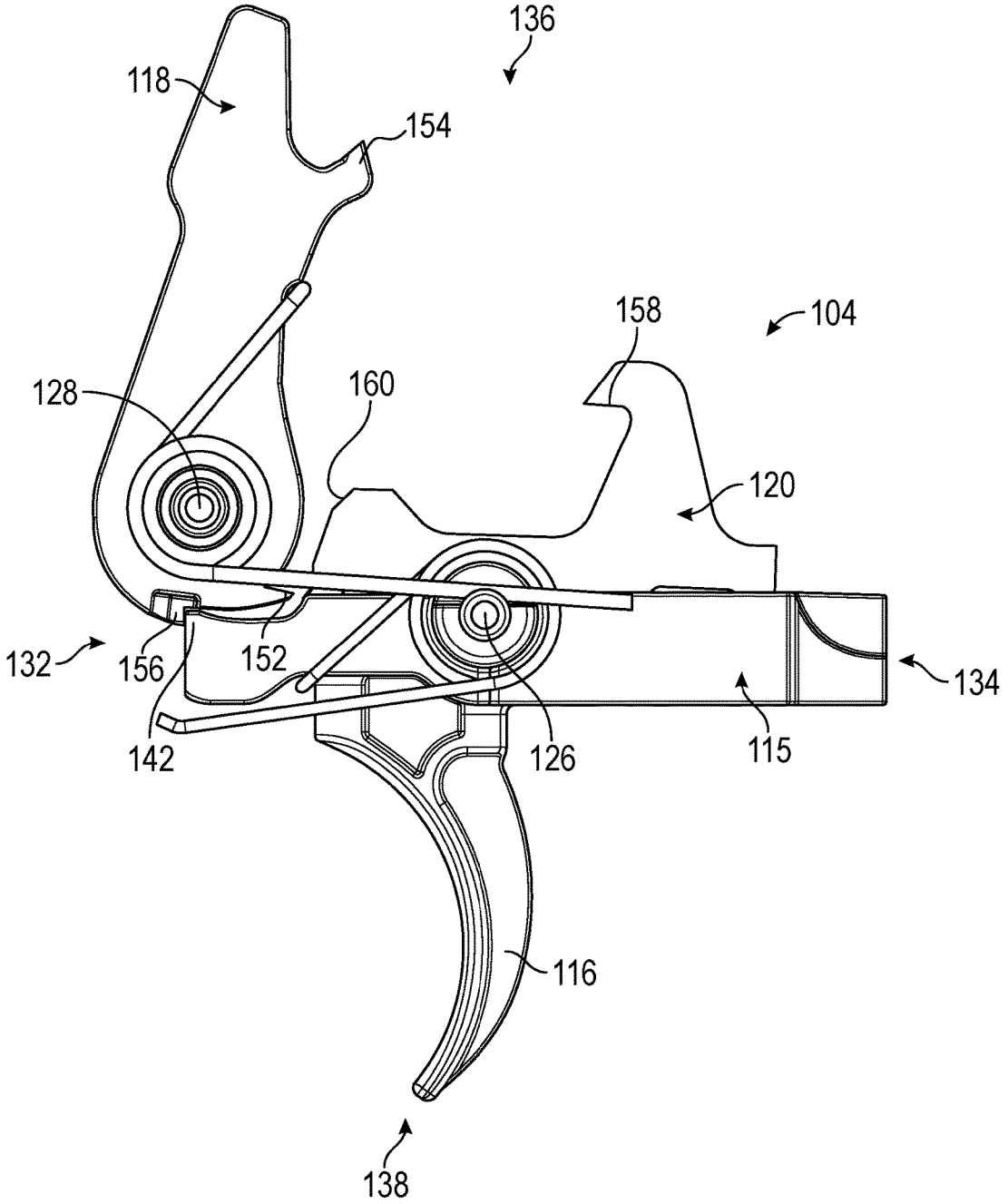
FIG. 16 illustrates the trigger mechanism of FIG. 2 in an intermediate position.

FIG. 16 shows the hammer element 118 in the intermediate position and the trigger element 117 in the ready position. As shown, the notch 156 of the hammer element 118 is engaged with the trigger sear 142. Specifically, the intermediate position of the hammer element 118 is a position where the hammer element 118 has not yet rotated to the fired position and the trigger element remains in the ready position. In some embodiments, even if the hammer element 118 is released from the intermediate position, the hammer element 118 will not have enough speed and power to discharge the firearm 100 to which it is attached.

Figure 17:
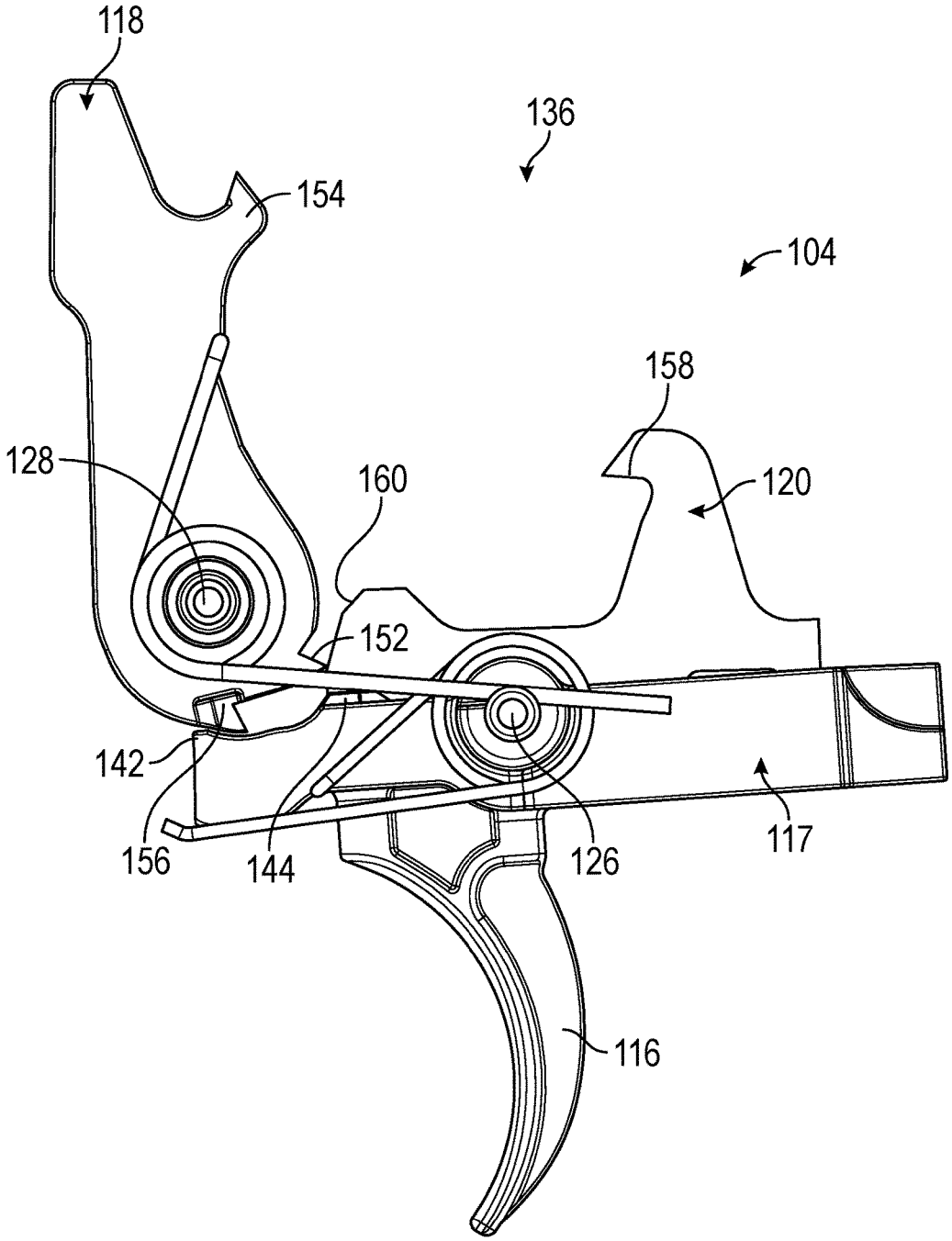
FIG. 17 illustrates the trigger mechanism of FIG. 2 in a fired position.

FIG. 17 shows the hammer element 118 and the trigger element 117 in the fired position. The trigger sear 142 is not in contact with any portion of the hammer element 118. In such a position, the hammer element 118 is positioned to discharge the firearm 100 to which it is attached. Upon discharging the firearm 100, the firearm 100 will begin to force the hammer element 118 in a direction back toward the ready position. As the hammer element 118 begins to rotate about the hammer element pin 128 toward the ready position, the trigger sear 142 travels over the notch 156 and over the first hammer sear 152.

Figure 18:
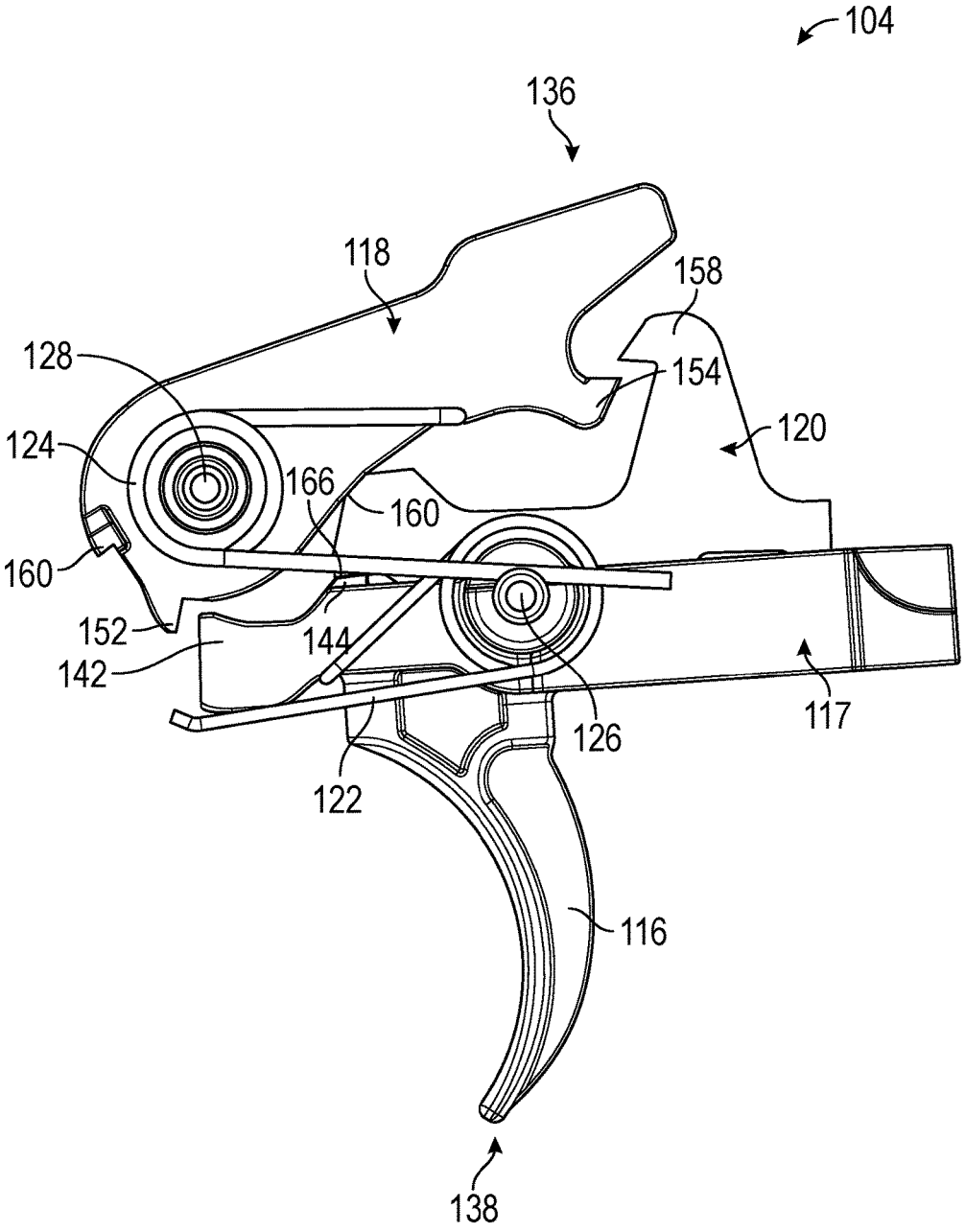
FIG. 18 illustrates the trigger mechanism of FIG. 2 in a position between the fired position and the ready position.

FIG. 18 shows the hammer element 118 in a position where the hammer element 118 is in contact with the hammer stop 160 of the disconnector 120. The trigger element 117 is shown in the fired position. At such a point in the firing cycle, the disconnector 120 receives the force from the hammer element 118 at the hammer stop 160 and transfers the force to the trigger disconnector pad engagement surface 166 and to the disconnector pad 144 of the trigger element 117. Once the force is received by the disconnector 120, the hammer element 118 begins traveling toward the fired position due to the spring force of the hammer element spring 124. Simultaneously, so long as there is not a force greater than the trigger element spring 122 being exerted on the trigger bow 116 toward the back of the trigger mechanism 104, the trigger element 117 moves from the fired position toward the ready position. Because the disconnector 120 is attached to trigger element 117, the disconnector 120 begins to rotate with the trigger element 117 thanks to the trigger element spring 126, which biases the trigger element toward the ready position. Specifically, the disconnector 120 rotates so that the disconnector sear 158 does not engage the second hammer sear 154. The hammer element 118 continues to rotate toward the ready position until the first hammer sear 152 engages the trigger sear 142. At such a point, the trigger mechanism is again in the ready position, as shown in FIG. 15.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A trigger mechanism for a firearm, the trigger mechanism comprising:

a hammer element moveable between at least three positions, wherein the hammer element comprises a main body, a hammer sear and a notch; and a trigger element comprising a trigger sear, wherein the trigger element is moveable between at least a ready position and a fire position, wherein the hammer element is engaged with the trigger sear in two positions of the at least three positions such that the trigger element is retained in the ready position; wherein the hammer sear and the notch each engages a different zone of the trigger sear; and wherein the notch projects from the main body in a direction generally parallel to an axis of rotation of the hammer element.

2. The trigger mechanism of claim 1, wherein the hammer element comprises a hammer sear and a notch, and wherein the trigger element is retained in the ready position when the hammer sear is engaged with the trigger sear defining a first position of the at least three positions and when the notch is engaged with the trigger sear defining a second position of the at least three positions.

3. The trigger mechanism of claim 2, wherein a width of the trigger sear is greater than or equal to a combined width of a width of the hammer sear and a width of the notch.

4. The trigger mechanism of claim 2, wherein the trigger sear comprises a hammer sear engagement zone and a notch engagement zone, and wherein a width of the hammer sear engagement zone is greater than or equal to a width of the hammer sear and a width of the notch engagement zone is greater than or equal to a width of the notch.

5. The trigger mechanism of claim 4, wherein when the hammer sear is engaged with the trigger sear, the hammer sear only engages the trigger sear at the hammer sear engagement zone.

6. The trigger mechanism of claim 4, wherein when the notch is engaged with the trigger sear, the notch only engages the trigger sear at the notch engagement zone.

7. The trigger mechanism of claim 4, wherein the hammer sear engagement zone is separate from the notch engagement zone.

8. The trigger mechanism of claim 2, wherein the hammer sear and the notch are positioned at a front of the hammer element, and wherein the hammer sear is spaced apart from the notch at the front of the hammer element.

9. The trigger mechanism of claim 2, wherein the hammer element comprises a main body, and wherein the hammer sear extends across a width of the main body and the notch projects from the main body.

10. The trigger mechanism of claim 2, wherein when the hammer element is in the first position and the trigger element is selectively moved from the ready position to the fire position, the notch bypasses the trigger sear.

11. The trigger mechanism of claim 2, wherein when the hammer element is in the first position and the hammer sear is inadvertently released from the trigger sear, the notch catches the hammer element on the trigger sear placing the hammer element in the second position.

12. The trigger mechanism of claim 2, wherein the hammer sear and the notch being disengaged with the trigger sear defines a third position of the at least three positions such that the trigger element is in the fire position.

13. The trigger mechanism of claim 2, further comprising a disconnector that includes a hammer stop and a trigger disconnector pad engagement surface, wherein the hammer stop receives a portion of the hammer element as the hammer element moves from being disengaged with the trigger sear that defines a third position of the at least three positions to the first position.

14. The trigger mechanism of claim 13, wherein the hammer stop is configured to direct a force generated by the hammer element to the trigger element via the trigger disconnector pad engagement surface at a point between a hammer rotation axis and a trigger element rotation axis.

15. The trigger mechanism of claim 2, further comprising a disconnector that includes a disconnector sear, wherein the hammer sear is a first hammer sear and the hammer element further comprises a second hammer sear, and wherein the second hammer sear engages the disconnector sear when the trigger element is held in the first position.

16. The trigger mechanism of claim 1, further comprising a safety mechanism moveable between a safe position that engages the trigger element and a fire position that disengages the trigger element, wherein when the safety mechanism is in the safe position, the trigger element is prevented from moving into the fire position.

17. The trigger mechanism of claim 1, wherein the trigger element further comprises a disconnector pad, and wherein the disconnector pad is positioned between the trigger sear and a trigger element rotation axis.

18. The trigger mechanism of claim 17, wherein a width of the disconnector pad is less than a width of the trigger element.

19. The trigger mechanism of claim 17, wherein the trigger element further comprises side walls, and wherein the disconnector pad is raised above the side walls.

20. A firearm comprising the trigger mechanism of claim 1.

* * * * *